US007062879B2

(12) United States Patent
Wenzl et al.

(10) Patent No.: US 7,062,879 B2
(45) Date of Patent: Jun. 20, 2006

(54) SECURITY GATE

(75) Inventors: Joseph F. Wenzl, Novi, MI (US); Peter M. Hines, Dearborn, MI (US); Robert W. Keyes, Pinckney, MI (US); Ronald A. Harrow, Dexter, MI (US); Jeffrey W. Mote, Northville, MI (US); Mitchell Van Ochten, Livonia, MI (US)

(73) Assignee: Federal APD, Inc., Novi, MI (US)

( * ) Notice: Subject to any disclaimer, the term of this patent is extended or adjusted under 35 U.S.C. 154(b) by 0 days.

(21) Appl. No.: 09/924,668

(22) Filed: Aug. 8, 2001

(65) Prior Publication Data

US 2003/0029089 A1 Feb. 13, 2003

(51) Int. Cl.
*E01F 13/00* (2006.01)

(52) U.S. Cl. ..... 49/49

(58) Field of Classification Search ..... 49/49, 49/138, 26, 28, 386
See application file for complete search history.

(56) References Cited

U.S. PATENT DOCUMENTS

| | | | | |
|---|---|---|---|---|
| 3,975,861 | A * | 8/1976 | Baump et al. | 49/28 |
| 3,993,975 | A * | 11/1976 | Long et al. | 49/28 |
| 4,335,339 | A | 6/1982 | Brickner | 318/282 |
| 4,338,552 | A | 7/1982 | Pilz et al. | 318/266 |
| 4,625,291 | A | 11/1986 | Hormann | 364/550 |
| 5,278,480 | A | 1/1994 | Murray | 318/626 |
| 5,525,876 | A | 6/1996 | Filippi | 318/282 |
| 5,982,119 | A | 11/1999 | Okada et al. | 318/286 |
| 6,086,177 | A | 7/2000 | Driendl et al. | 312/466 |
| 6,104,156 | A | 8/2000 | Bruno | 318/434 |
| 6,179,517 | B1 * | 1/2001 | Nelson | 49/26 |
| 6,523,788 | B1 * | 2/2003 | Zander | 49/49 |
| 6,618,993 | B1 * | 9/2003 | Burke | 49/49 |

FOREIGN PATENT DOCUMENTS

| | | | | |
|---|---|---|---|---|
| EP | 0443052 | A1 * | 2/1990 | 49/49 |

* cited by examiner

*Primary Examiner*—Jerry Redman
(74) *Attorney, Agent, or Firm*—Leydig, Voit & Mayer, Ltd.

(57) ABSTRACT

A security gate is coupled via a positive-drive mechanical linkage to a DC gear motor, operative in response to a defined output voltage profile, to provide precise rotation and counter-rotation of the security gate through a defined range of motion.

15 Claims, 15 Drawing Sheets

FIG. 10a
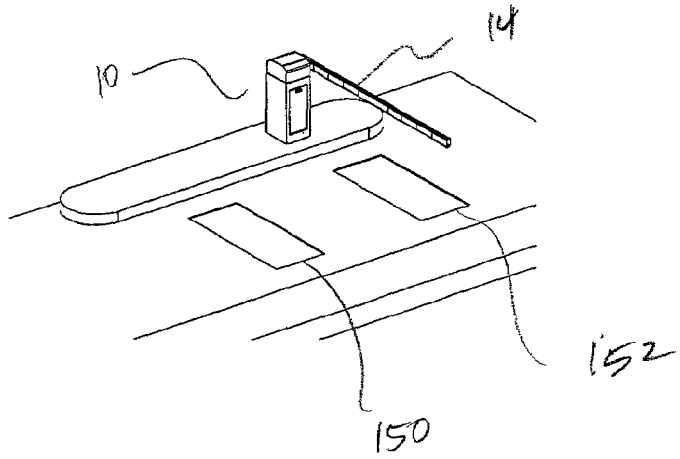
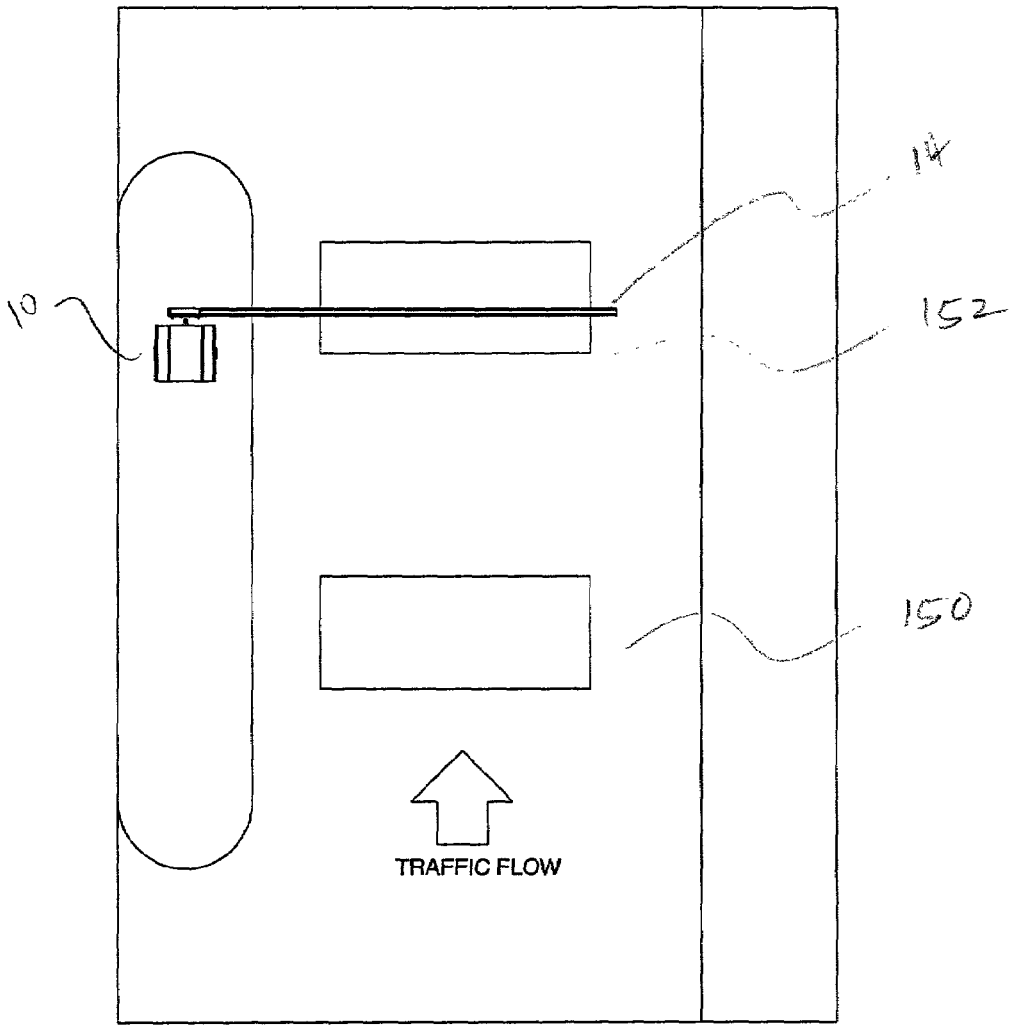
FIG. 10b

FIG. 11a
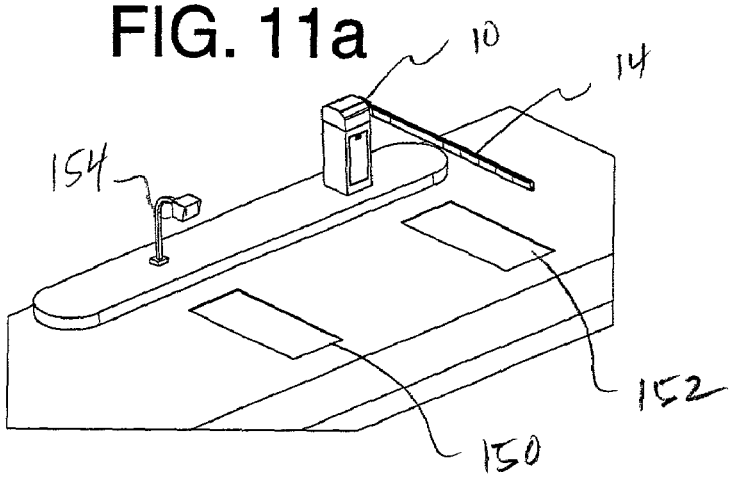
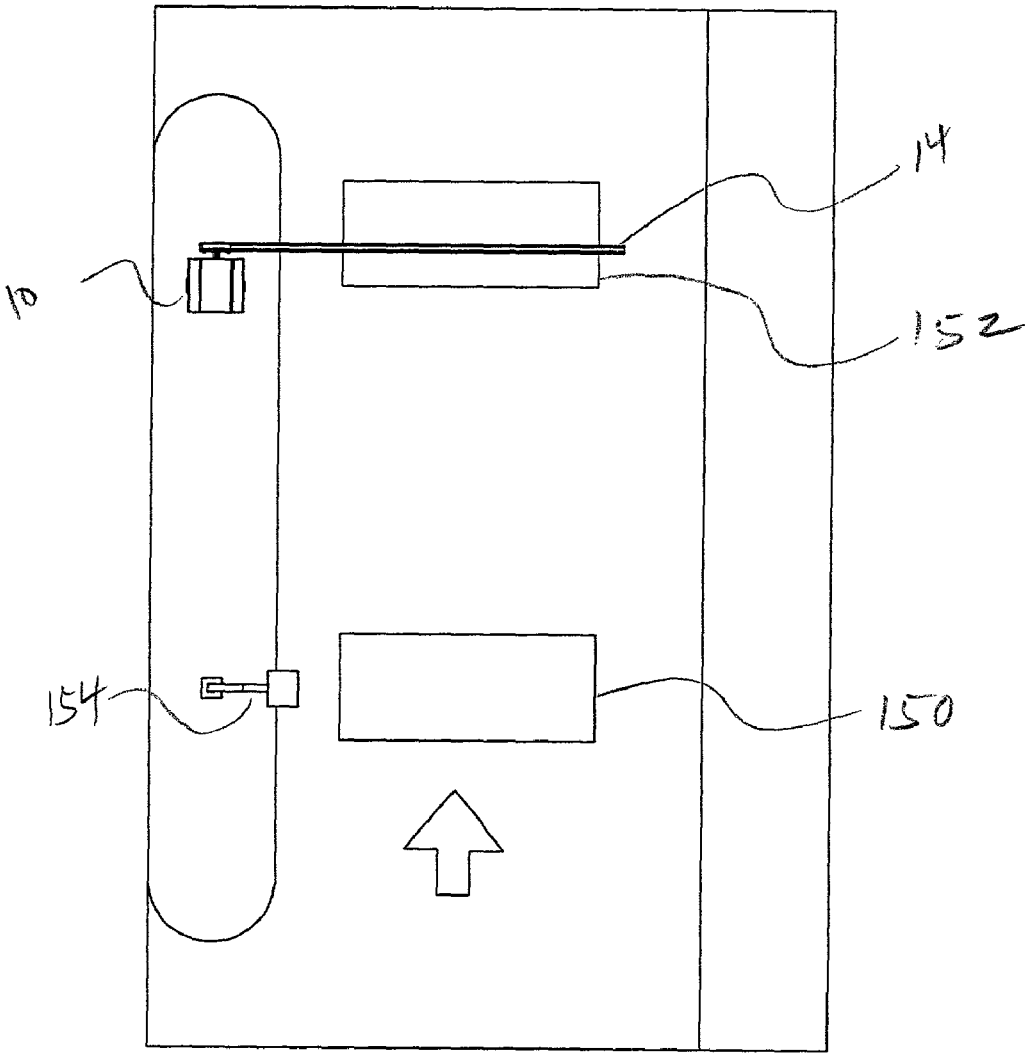
FIG. 11b

FIG. 12a
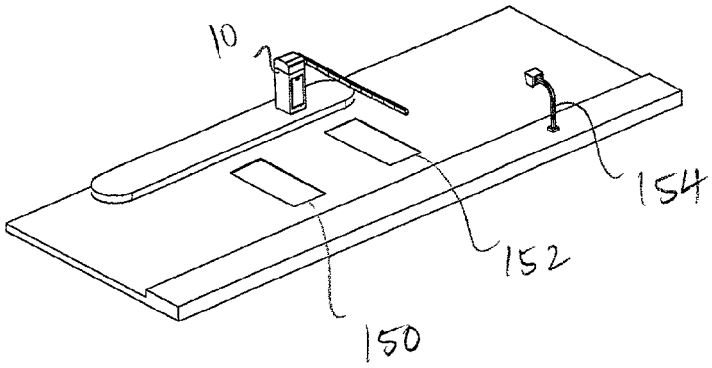
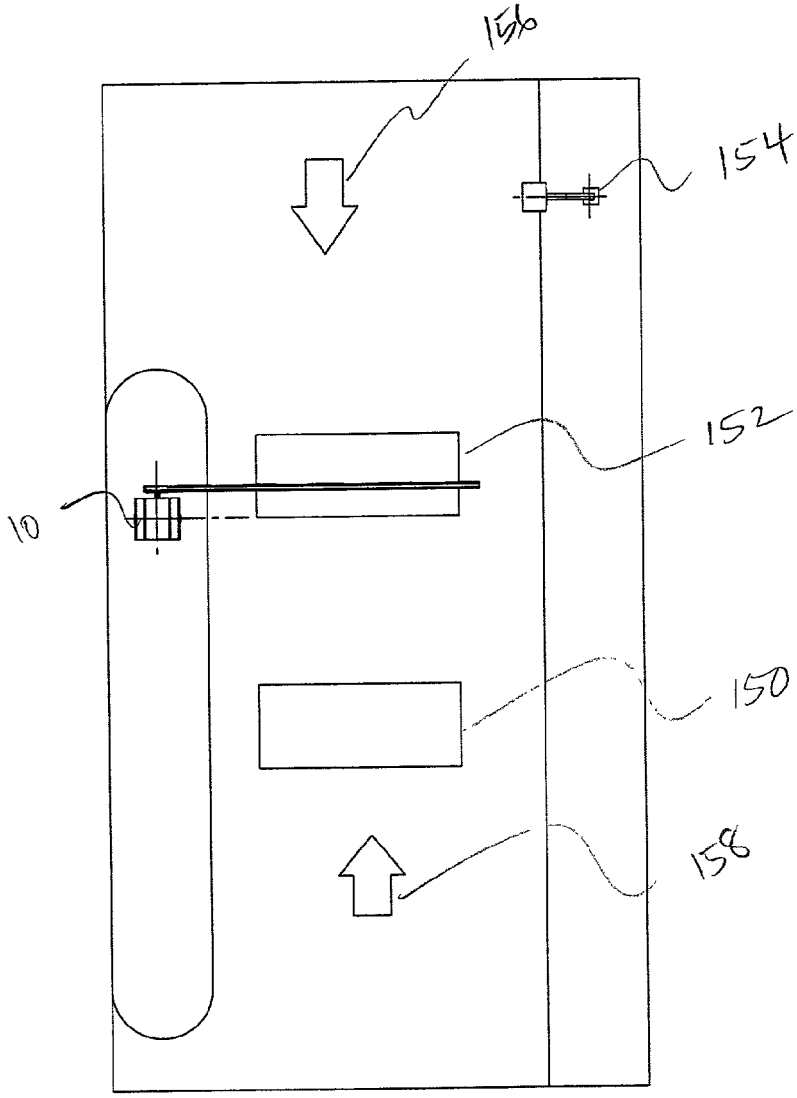
FIG. 12b

SECURITY GATE

FIELD OF THE INVENTION

This invention relates generally to security gate structures and the art and science of controlling the same. More particularly, the invention relates to a security gate arm having controlled movement over a defined pathway to selectively allow vehicles to enter and exit parking or secure structures.

BACKGROUND OF THE INVENTION

In conditional access structures such as parking structures and the like, industrial gates are used to control the entrance and exit of vehicles. These industrial gates typically include a movable gate arm, pivotally attached at one of its ends to a gate support. The gate arm may be designed to prevent the unauthorized entrance or exit of a vehicle through a defined pathway of the structure. Upon the occurrence of an event, such as by payment of an access fee or by authorization of the vehicle by security personnel, the gate arm rotates out of the pathway to permit passage of the vehicle. The security gate itself sometimes includes one or more co-acting pieces, and is typically fabricated of wood, metal or other appropriate material. The length and therefore the weight of the gate arm vary depending on the dimension of the pathway in which the security gate is placed.

Industrial-type security gates are sometimes automated through the use of sensing apparatus for detecting approaching and departing traffic. The sensing apparatus usually includes inductive vehicle sensor loops embedded in the roadway at a spaced location relative to the security gate. Thus, when a vehicle approaches the security gate, the signal generated by the vehicle sensor may cause the gate to be automatically operated based on the sensing of a vehicle in the defined area. Alternatively, vehicle sensors are sometimes used in conjunction with a vending mechanism that is adapted to require the tender of a magnetic card, ticket, cash amount or the like. In many of these arrangements, the gate is operable to permit passage of the vehicle upon a sequential sensing of the vehicle and an authorization such as through payment or through a card reader.

U.S. Pat. No. 3,975,861 to Baump et al., entitled "Automated Parking Gate and Controls" discloses a security gate of the general type discussed above. The disclosed security gate includes a movable, elongate blocking arm that is lifted or lowered to permit vehicle entrance to and exit from a parking structure. To operate the security gate, a reversing alternating current (AC) electric drive motor is actuated upon the receipt of control signals from rather rudimentary logic circuitry. In particular, the logic circuitry provides signals to reverse or cease operation of the motor upon a sensing of certain conditions, such as when the gate strikes an object. This arrangement prevents unintended closure on vehicles or pedestrians entering the structure.

Security gates known in the art to this point, such as the gate disclosed by Baump et al., suffer from various drawbacks. For example, presently known security gates typically employ AC induction motors that supply torque to a gate arm moving mechanism to lift and lower the security gate arm. The induction motor size, voltage rating and operating frequency, as well as the gear reduction ratio of the motor output, are chosen as a function of the size and weight of the security gate arm. Since different geographical regions supply AC power at different voltages and at different frequencies, the same AC induction motor cannot be universally used for a security gate intended to be installed at different locations. For example, the typical AC power supply in the United States provides 120 or 240 volts at 60 cycles per second. In Europe, the typical AC power supply is 240 volts at 50 cycles per second. To summarize, the selection and design of components such as the AC induction motor and reduction or drive gear mechanisms must now be customized for each security gate installation based on such factors as the intended geographical location of installation, the dimension of the gate arm, and the weight of the gate arm.

To avoid injury to humans or damage to other objects, most security gate installations include a number of sensors. For example, a contact or proximity sensor is usually placed on the gate arm leading edge to detect whether the gate contacts or is in close proximity with a vehicle or other object. When the sensor detects such an obstruction, a signal is generated to direct the gate arm to be stopped or to reverse movement. Alternatively, or in addition to contact sensor arrangements, presently known gates sometimes use a current sensor for this purpose. The current sensor detects relative changes in motor current such as would be the case when the gate strikes an object as it is lowered. These sensors, however, add complexity to the design of the security gate. Additionally, they provide additional possible failures in the operation of the security gate.

Many security gates also include a mechanism to prevent the gate arm from being lifted either by accident or without authorization. In some security gates, internal motor rotor friction, as applied through a gearbox reducer, prevents the gate arm from being unintentionally or improperly lifted. At the same time, however, the security gate must be designed such that vehicles can still enter and exit the structure when power to the security gate is lost. To this end, security gates sometimes include a mechanism for automatically raising the gate arm in the event of a power loss.

SUMMARY OF THE INVENTION

The present invention is directed to an improved security gate that addresses many of the disadvantages of the prior art. In one aspect, a security gate assembly comprises a direct current (DC) drive motor that provides an output torque that is coupled with a gate arm. A power converting circuit operable to convert supplied electricity of any voltage and frequency to an appropriate DC voltage level applies an output pulse of a desired voltage profile to drive the DC motor. Thus, the invention may be utilized in different geographical regions without motor customization for a particular region of the world in which the security gate is installed.

The DC motor is coupled to the gate arm via a linkage mechanism. In one embodiment, a mechanical linkage transfers torque from the DC gear-motor output to the gate arm along a sinusoidal waveform to limit the amount of power required to move the gate arm from a horizontal position. In any event, the linkage mechanism transfers the DC motor output to rotate the gate arm along a defined pathway of travel.

In accordance with another feature of the invention, an adaptive control mechanism provides control signals to the power converting circuit. In particular, an output control circuit supplies a variable output signals to precisely control the amount of power delivered to the drive motor. For developing these control signals, various operating conditions are monitored. These include the position and angular speed of the gate arm based on pulses developed by the motor indicative of motor position. The control circuit also uses input data regarding the gate arm size and weight. The invention uses a voltage controller circuit to control the DC gear-motor in order to provide the appropriate amount of power to lift the gate arm. Thus, for example, for larger and heavier gate arms, the voltage controller circuit causes the delivery of additional power to the DC gear motor, which in turn provides additional torque to the arm lifting mechanism.

BRIEF DESCRIPTION OF THE DRAWINGS

FIGS. 10A–B, FIGS. 11A–11B, and FIGS. 12A–12B illustrate the gate assembly configured in various operating modes.

DETAILED DESCRIPTION OF THE PREFERRED EMBODIMENTS

The present invention generally relates to a security gate that is controlled in various operable modes. A positive-drive linkage mechanism couples a gate arm with a direct current (DC) gear-motor, responsive to a control voltage pulse of a predetermined duration. In another aspect of the invention, an adaptive control system provides the control signals for driving the DC gear-motor. For developing these control signals, a microprocessor-based controller circuit executes a control program, developed through object-oriented programming techniques, to provide very accurate control of the security gate in various modes of operation and depending on operating parameters and conditions.

Figure 1:
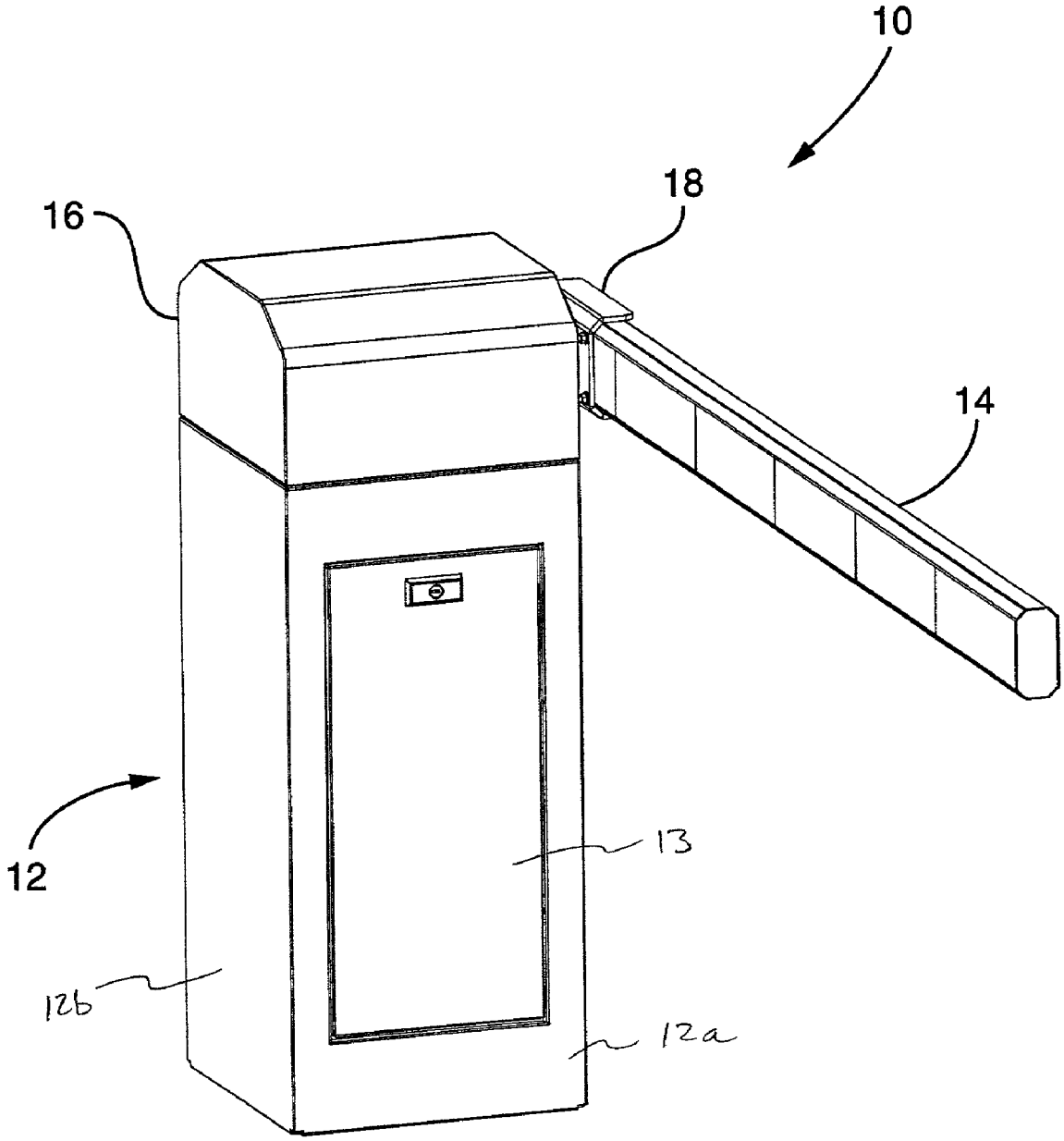
FIG. 1 is a perspective view of a security gate structure according to the present invention.
Figure 2:
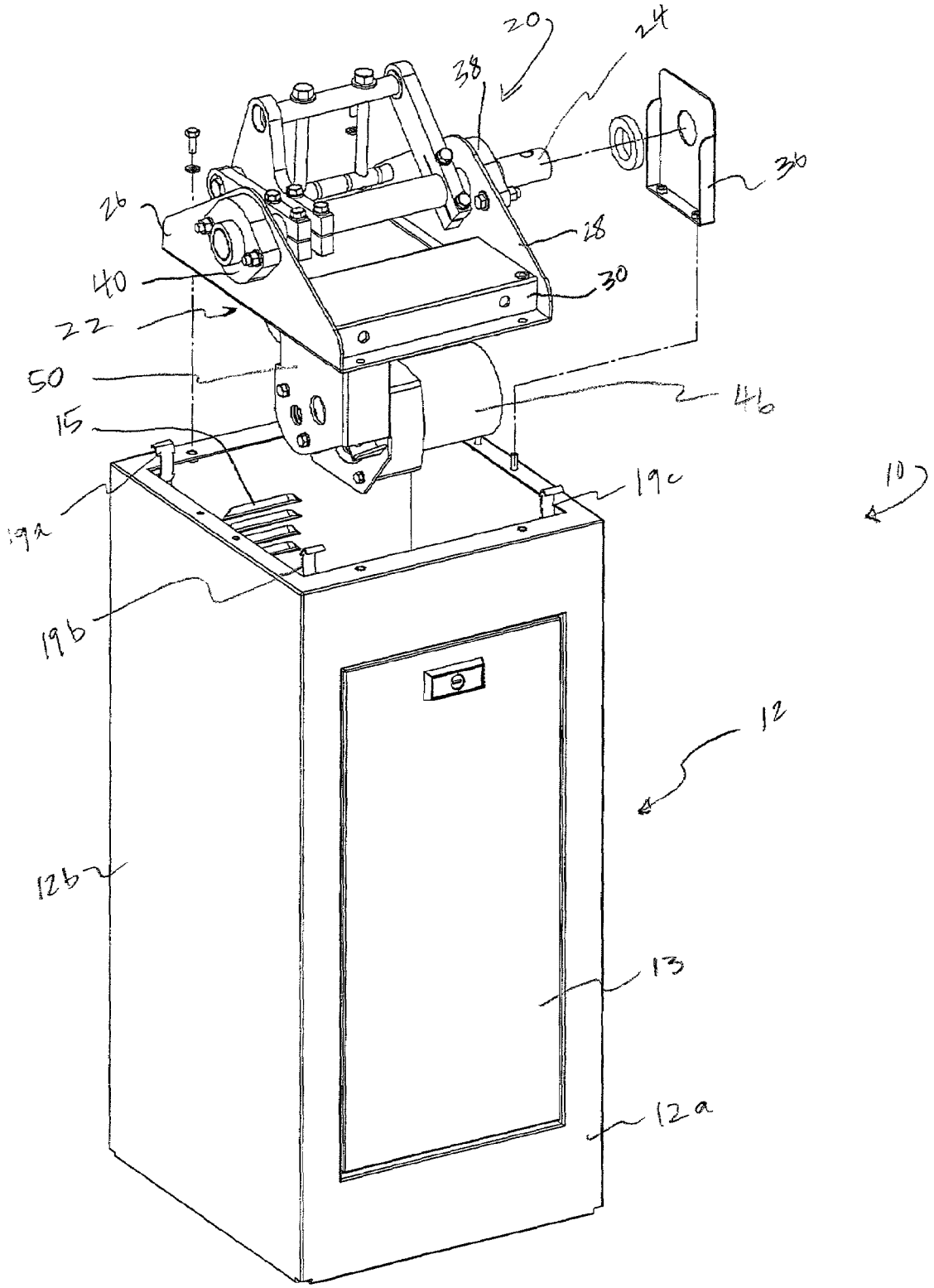
FIG. 2 is a partially exploded view of the gate structure of FIG. 1 illustrating an actuating and linkage mechanism according to the invention in greater detail.

FIG. 1 is a perspective view of a positive-drive security gate assembly 10. The security gate assembly 10 includes an upright frame enclosure 12 having generally rectangular side walls 12*a–d*. In a preferred embodiment, the enclosure 12 is fabricated of galvanized steel, but many other suitable materials may be used as well. A panel access door 13 is located on one of the sidewalls 12*a* to permit access to the internal electrical components of the gate assembly. To prevent excessive temperature buildup, louvers (denoted as numeral 15 in FIGS. 2 and 8) and/or cutouts may be formed in the enclosure sidewalls 12*a–d*. This advantageously permits air circulation within the enclosure 12 while preventing excessive moisture buildup within the enclosure.

The frame enclosure 12 supports an outwardly extending, elongate gate arm 14, rotatably mounted to the enclosure 12 with the use of an actuating and linkage subassembly 20. The linkage subassembly 20 is shown, in an exploded view, in FIG. 2, and is explained in greater detail below. The gate arm 14 may be fabricated from a variety of materials, including wood, fiberglass or other suitable material. In the embodiment of FIGS. 1–8, the gate arm 14 is formed from an aluminum extrusion. Depending on the installation, it typically is of a variable length and weight. In this embodiment, the gate arm size ranges from about 10 to 20 feet and is constructed of a lightweight, extruded aluminum material. The gate arm 14 is preferably hollow and includes caps (such as end-cap 17 shown in FIG. 7) disposed at its ends to prevent snow, ice or debris build-up inside the gate arm. As explained below, one unique feature of the invention permits a single motor/gearbox and counterbalance arrangement to operate different gate arm lengths, such as lengths ranging from about eight to 20 feet, with the addition or deletion of counterbalance springs.

In addition to supporting the gate arm 14, the enclosure 12 provides a housing for the electrical components used to drive the gate arm as well as the mechanical linkage according to the invention. In particular, these items are implemented as the actuating and linkage subassembly 20, shown in FIG. 2. As seen, this actuating and linkage mechanism 20 is located within an upper portion of the enclosure 12. A removable cover piece 16 provides ready access for adjustment or maintenance of the linkage mechanism and/or other components housed within the enclosure 12. Preferably, the cover piece 16 is a steel or aluminum cover, attached to the enclosure with the use of latches, such as the latches 19*a–c* shown in FIG. 2.

The gate arm 14 is configured to operate in various modes. These include a mode in which a payment or authorization system is utilized to control actuation of the security gate assembly 10. The security gate may also be configured to operate only upon receipt of an authorization signal, such as from security personnel. Alternatively, the gate may operate only upon the sensing of a vehicle within proximity of the gate. In any event, the invention typically uses vehicle-sensing apparatus, such as inductive loop detectors, to provide information concerning the presence of a vehicle at a predetermined location relative to the gate arm, such as an entrance point to the parking structure. These are usually located at a known, spaced location in close proximity to the gate assembly 10.

In accordance with one feature of the invention, a linkage mechanism couples the gate arm with a drive mechanism to positively rotate the gate arm over a well-defined pathway. This structure provides increased control of gate arm movement. At the same time, the amount of overall power required to drive the gate arm over its entire range of motion is reduced.

Figure 5:
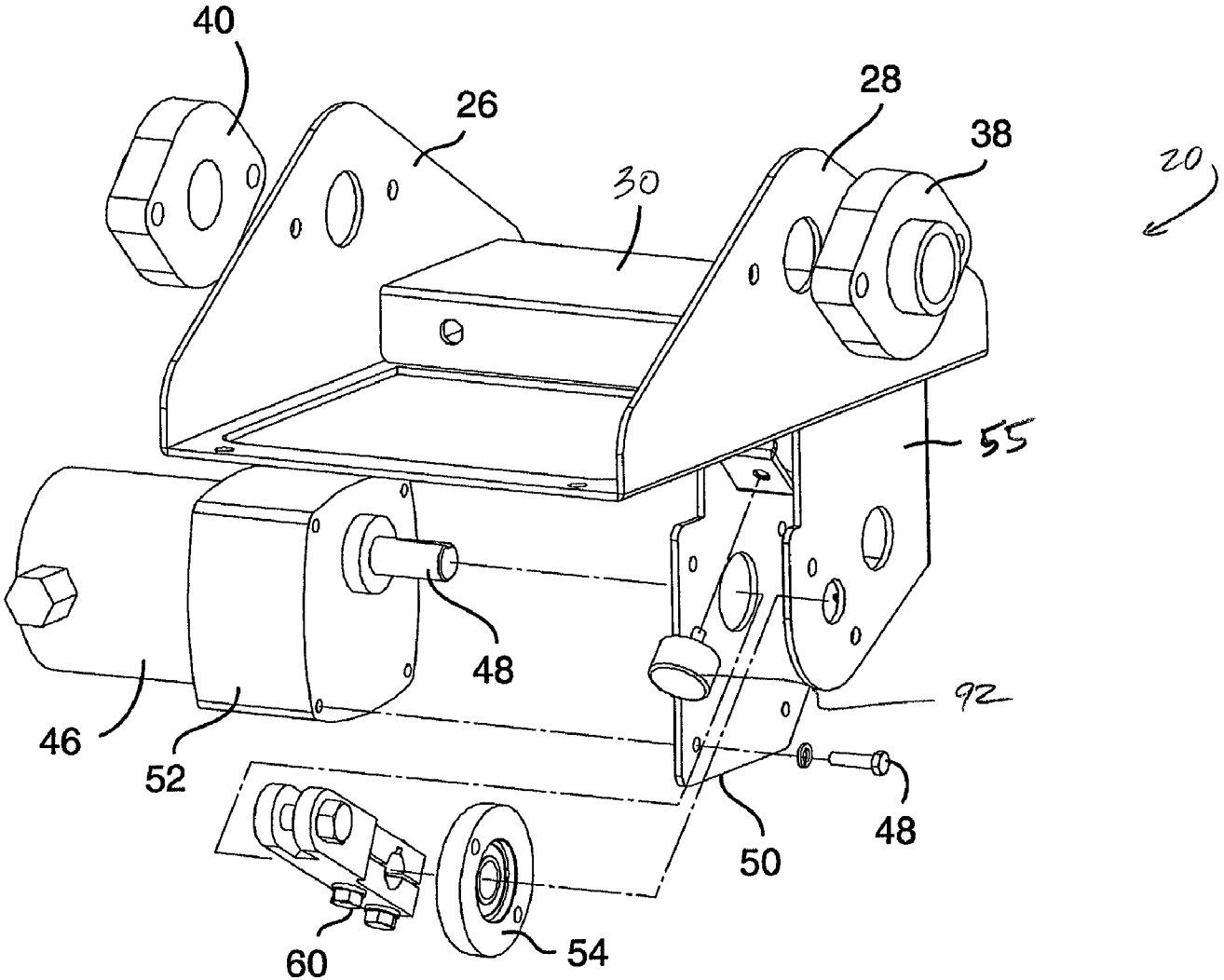
FIG. 5 is an exploded view of a frame subassembly for the actuating and linkage mechanism shown in FIGS. 2 through 4.
Figure 6:
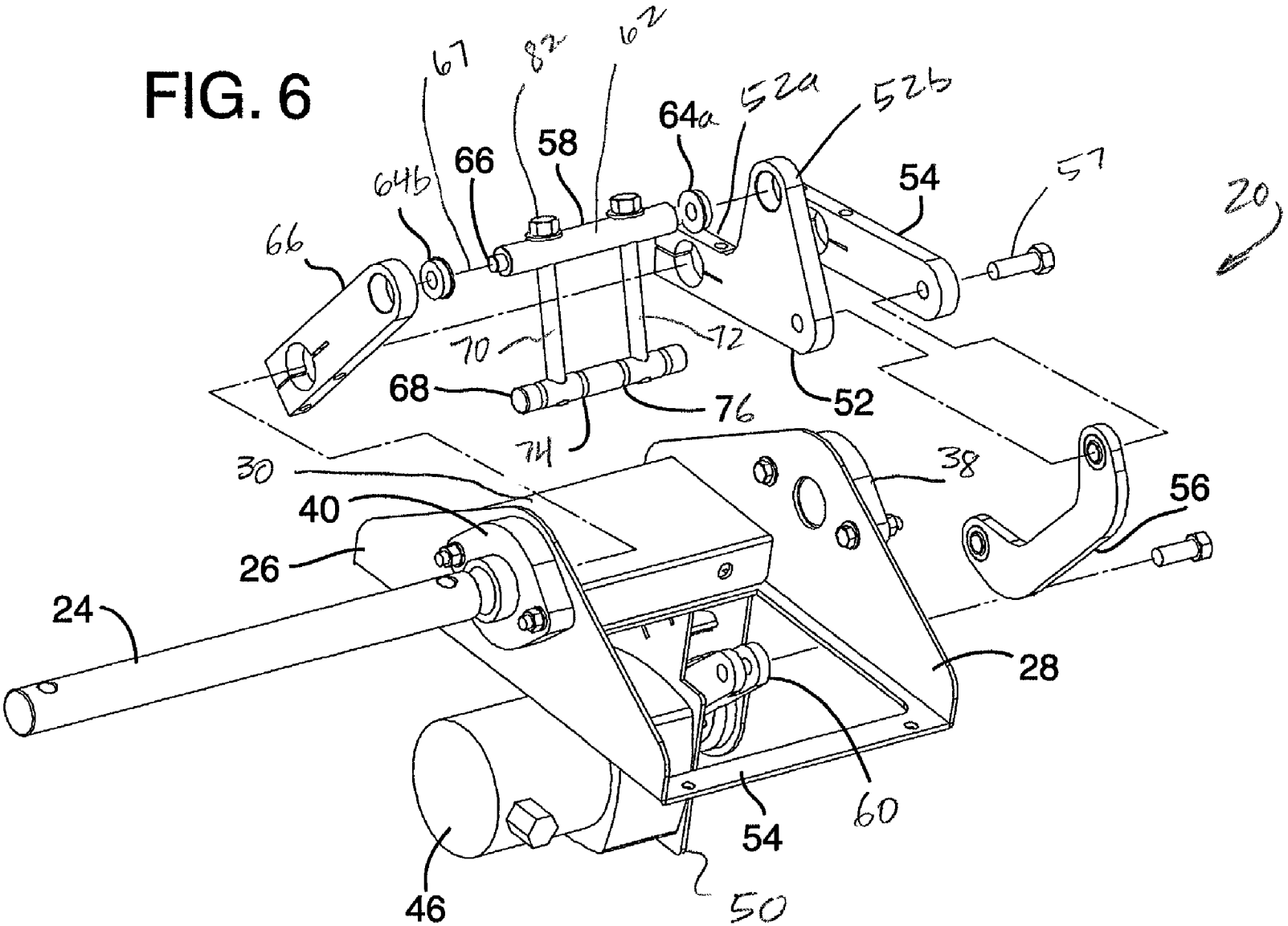
FIG. 6 is an exploded view of the linkage subassembly for the actuating and linkage mechanism.
Figure 7:
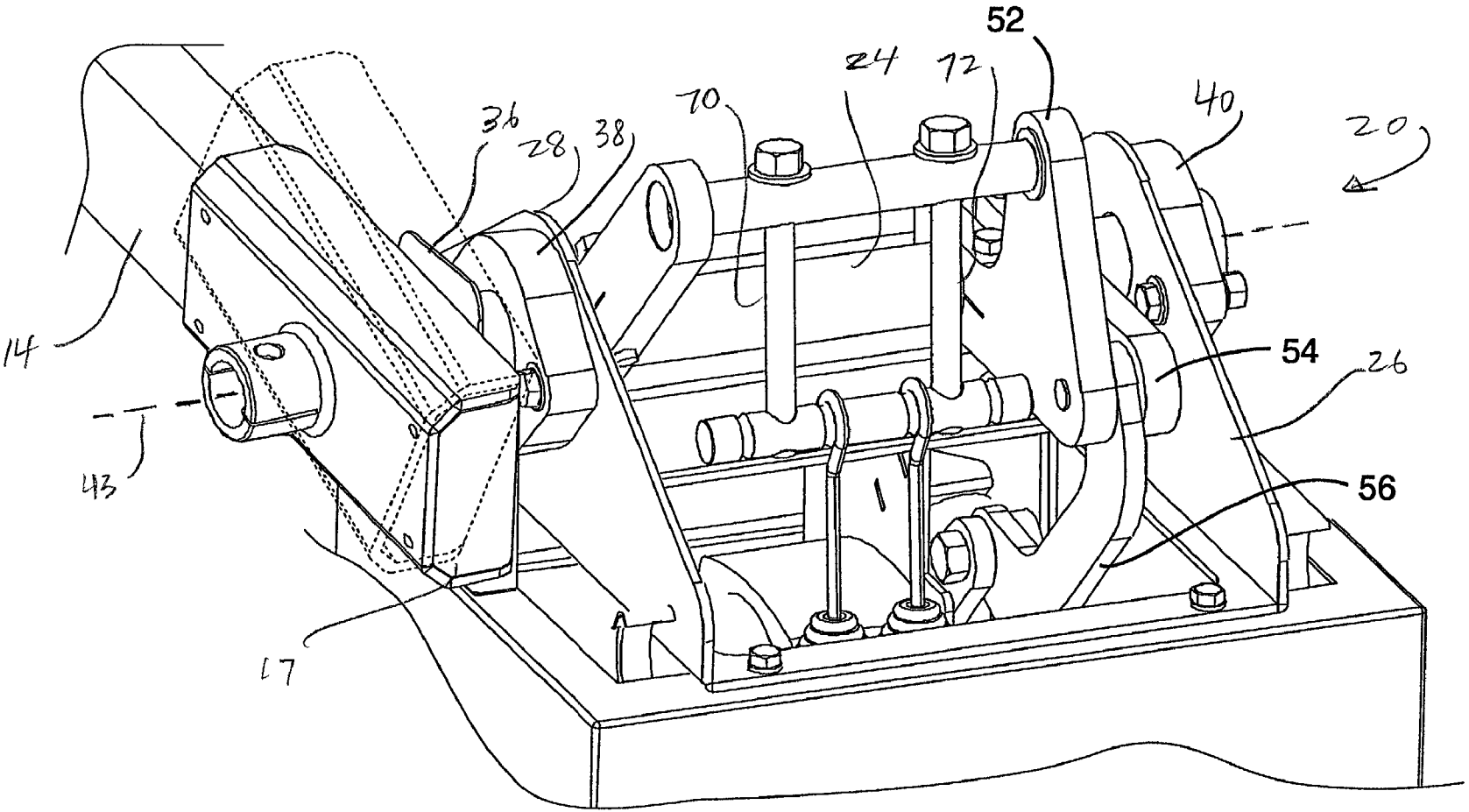
FIG. 7 is a perspective view of the linkage subassembly shown in a first operative position.
Figure 8:
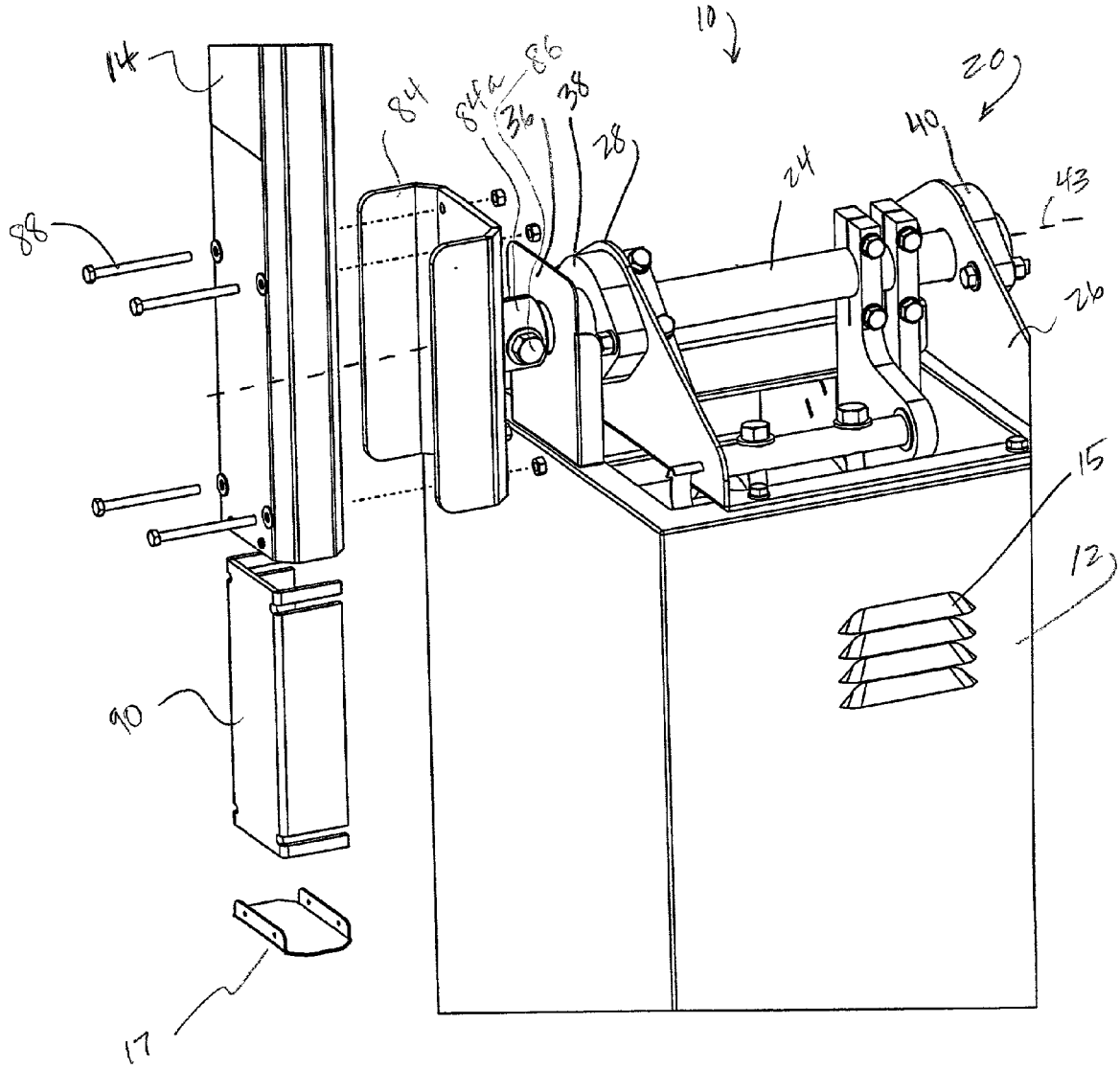
FIG. 8 is a perspective view of the linkage subassembly shown in a second operative position.

The main structural details of the mechanical linkage and drive subassembly 20 for the security gate 10 are illustrated in FIGS. 2 through 8. A linkage frame 22 attaches the linkage subassembly 20 to the enclosure 12. The linkage frame 22 includes cooperating frame support pieces that permit free rotation of a main drive shaft 24 for the gate arm. The main drive shaft 24 is operably connected to one end of the gate arm 14, as best seen in FIGS. 7 and 8. In one embodiment, the linkage frame 22 includes opposed, generally triangular frame pieces 26, 28 that extend the widthwise dimension of the enclosure 12 such that they may be secured to the enclosure sidewalls 12*a* and 12*d* (see FIGS. 3 and 4). A cross-bracket frame piece 30, extending laterally between the frame pieces 26 and 28, provides lateral support for the linkage frame 22. For shielding the main shaft 24 proximate to its attachment point to the gate arm 14, a shroud 36 extends upwardly from an enclosure sidewall 12*c*.

As shown in FIGS. 2 through 8, the linkage frame 22 rigidly supports a pair of opposed, main drive shaft bearings 38, 40. The main drive shaft bearings 38, 40 have a generally oval outer configuration so that they may be secured to the outer sides of the opposed, frame pieces 26, 28, respectively, with the use of fastening screws such as fastening screw 42 shown in FIG. 3. As explained in greater detail below, the drive shaft bearings 26, 28 include inner bearing surfaces that permit free rotation of the main drive shaft 24 about a gate drive axis of rotation. This axis of rotation is shown in the drawings as an axis 43.

In keeping with one feature of the invention, the main drive shaft axis of rotation 43 is adapted to pass through a centerline of the gate arm 14, as shown in FIGS. 7 and 8. This structure advantageously permits handing of the gate arm assembly 10. In other words, the gate assembly 10 may be located to the right side of a roadway entrance in the configuration shown in FIGS. 1 through 8. To locate the gate assembly 10 at the opposite side of the roadway, the plastic cover 16 is simply removed so that the main drive shaft 24 may be oppositely positioned. This design offers greater flexibility as compared to known designs that require substantial effort to change the gate orientation depending on the side of a roadway that it is positioned.

Figure 4:
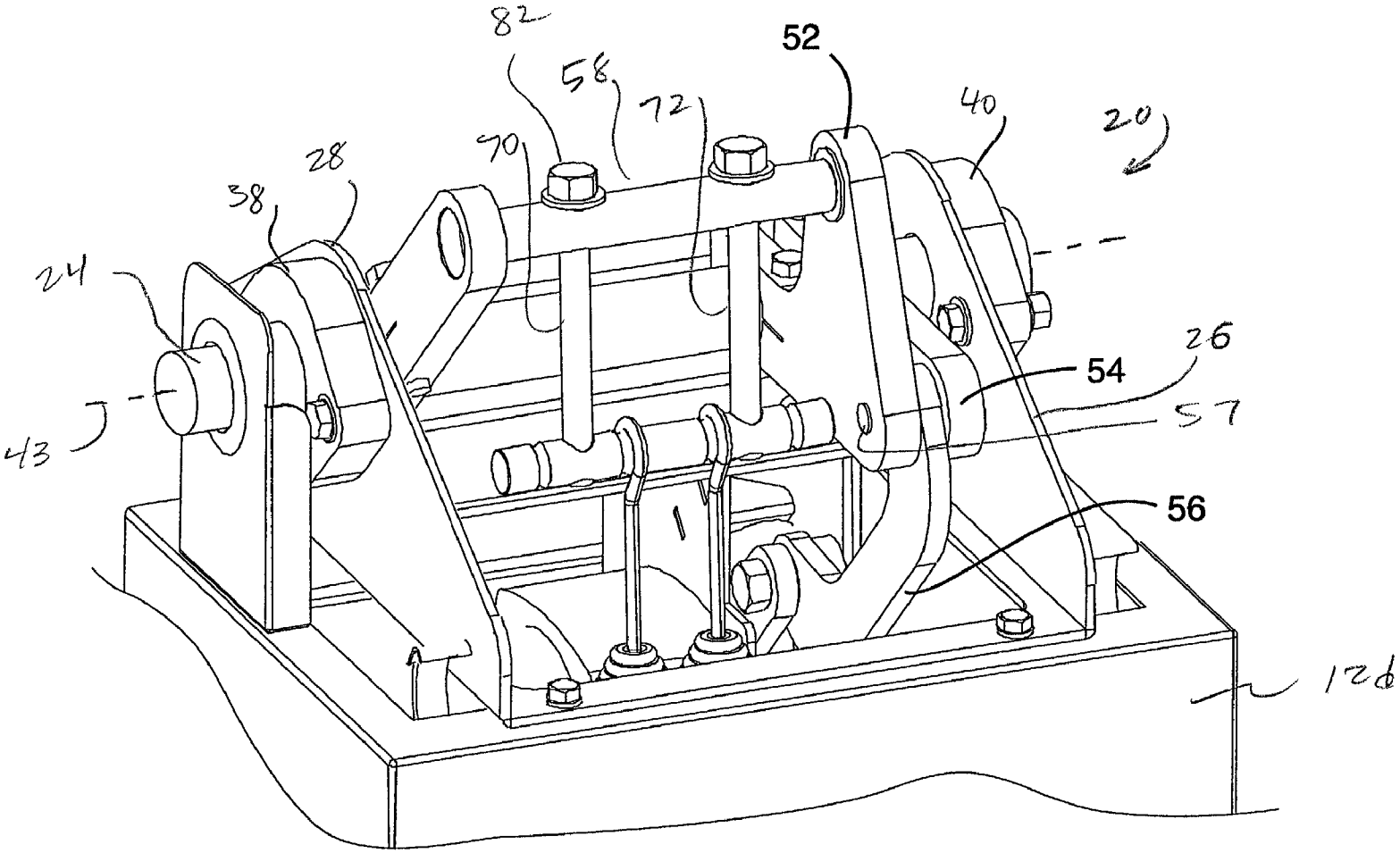
FIG. 4 is another perspective view, looking from the opposite way, of the mechanism shown in FIGS. 2 and 3.

In one embodiment of the invention, a drive mechanism is implemented as a DC motor and gear reduction mechanism (sometimes referred to as a "DC gear-motor"), operable to provide an output torque for actuating the gate arm. In the embodiment shown in FIGS. 3 through 5, a downwardly extending mounting bracket 50 supports a DC gear-motor 46. The gear-motor 46 is secured to the mounting bracket 50 via mounting screws such as screw 48. The DC gear-motor 46 is preferably a brushless DC motor, manufactured by such companies as Bodine Electric, and is operative to receive voltage drive pulses with a maximum amplitude of 24V DC and for a predetermined duration. An output shaft (not shown) for the DC gear-motor 46 is coupled with reduction gear mechanism (not shown) housed below the mechanism frame 30. The reduction gear arrangement provides a desired output torque via a motor drive shaft 48 as will be understood by those skilled in the art. As best seen in FIG. 5, the motor drive shaft 48 is located within a shaft support bearing 54. The support bearing 54 is secured to a downwardly extending linkage frame piece 55 and permits free rotation of the motor drive shaft 48 therewithin.

For providing a linkage between the motor output shaft and the gate arm, a positive sinusoidal drive linkage mechanism is utilized. In particular, the linkage mechanism is a direct drive mechanism. The sinusoidal linkage provides a mechanical advantage at the beginning and end of travel during the gate cycle. Importantly, the linkage structure according to the invention provides its greatest mechanical advantage when the gate arm is at its ends of travel. This permits reduced power to actuate the gate arm. Also, the gate arm is essentially placed in a locked position when located at one of its ends of travel. In the illustrated embodiment, the linkage subassembly 20 comprises various coacting link pieces: an output crank link piece 60 that is secured to the output motor drive shaft 48; a pair of main shaft crank pieces 52 and 54; and a banana-shaped connecting link piece 56 for mechanically coupling the main shaft crank pieces 52 and 54 with the output crank linkage piece 60.

The main shaft crank pieces are implemented as an L-shaped inner shaft crank piece 52 and a generally rectangular outer shaft crank piece 54. The inner main shaft crank piece 52 has one of its legs 52*a* disposed to securely engage the main drive shaft 24 with the use of locking screws such as screw 53 shown in FIG. 3. Similarly, the outer shaft crank piece has one of its ends securely fastened to the main drive shaft 24 with the use of locking screws such as screw 55. The use of a pair of crank pieces 52 and 54 prevents lateral movement of the linkage mechanism, and thus, reduces the tendency for wear of the bearings (not shown) for the main connecting rod 56.

Figure 3:
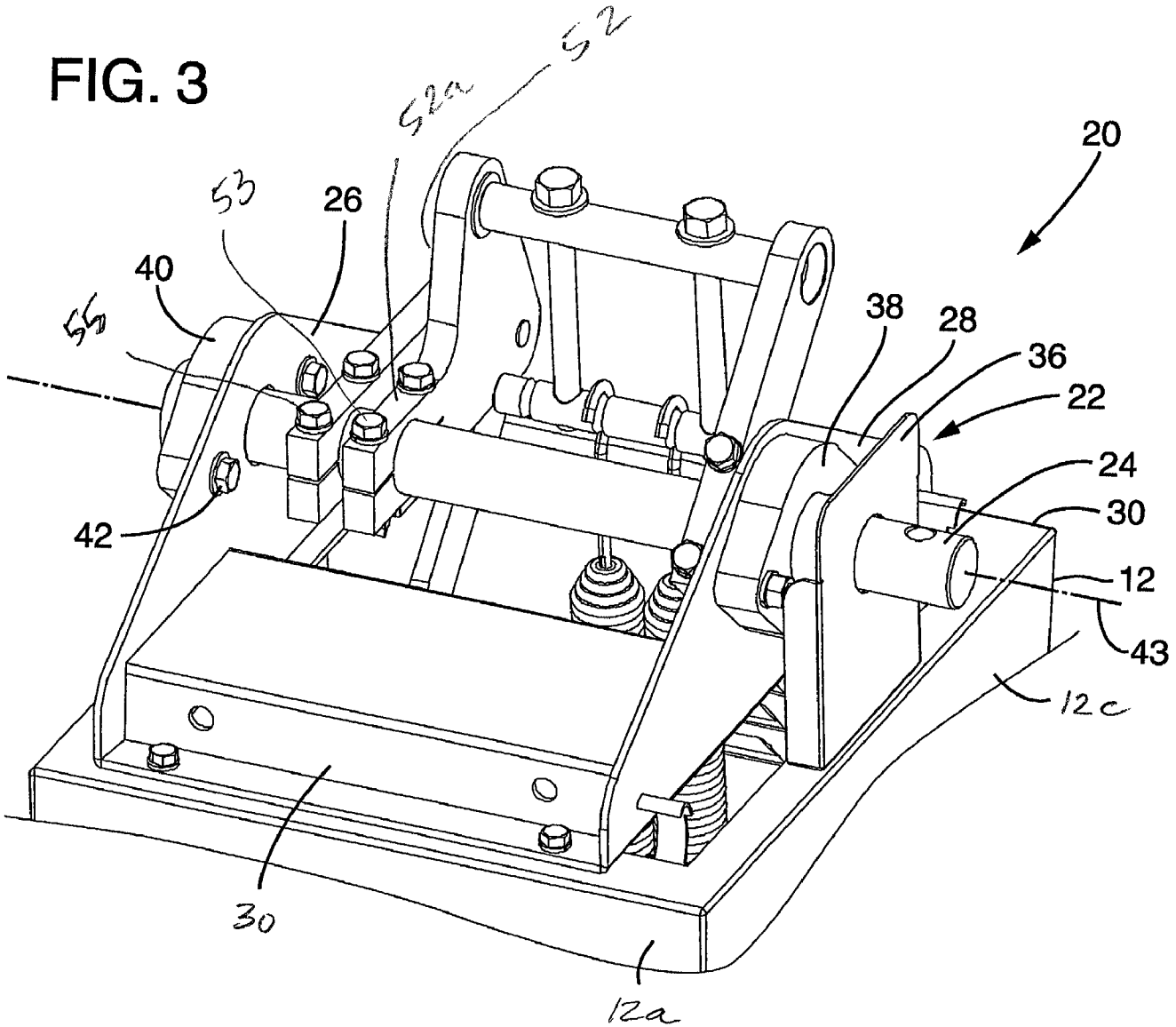
FIG. 3 is a perspective view of the mechanism shown in FIG. 2.

For connecting the main shaft with the motor output, a banana-shaped connecting rod is utilized, as noted above. In the illustrated embodiment, a connecting rod piece 56 is attached to the distal ends of the main shaft crank pieces 52 and 54, opposite their connection to the main shaft 24 itself. Thus, as shown in FIGS. 3 and 4, a rod bearing 57 extends through the distal ends of the inner and outer crank pieces 52 and 54, as well as a first end of the connecting rod piece 56. The connecting rod 56 is mounted, at its opposite end, to the output crank link piece 56.

To reduce the load applied by the gate arm, a counterbalance arrangement is preferably employed. The output torque required by the DC gear-motor 46 to lift the gate arm is reduced in various operating modes. In one embodiment, a counterbalance spring arrangement is used to counteract the weight of the gate arm. The arrangement is adapted to extend as the gate arm is lowered. On the other hand, the spring assembly contracts as the gate arm is lifted.

In the illustrated embodiment shown in FIGS. 3, 4 and 6, the end of the leg 52*b* of the inner shaft crank piece opposite the main crank 24 is adapted to receive a four-element pivot bar 58. In particular, a first pivot bar axle 62 is rotatably mounted to the crank piece leg 52*b* with the use of a pivot bearing 641. At its opposite end, the pivot bar axle 62 is rotatably mounted to a pivot bar connecting piece 66 with the use of a pivot bearing 64*b*. At its opposite end, the connecting piece 66 is securely coupled to the main crank 24. The opposed pivot bearings 64*a* and 64*b* are located within openings formed in the opposed crank pieces 52 and 66, respectively, and permit rotation of the pivot bar 58 about a pivot bar axis 67 (see FIG. 6). The pivot bar axis is, of course, offset from the main crank axis of rotation 43.

The pivot bar 58 supports a laterally extending spring connection bar 68 with the use of a pair of connecting rods 70 and 72. The spring connection bar 68 includes multiple, spaced grooves such as grooves 74 and 76 formed therein. Each of the grooves 74 and 76 is adapted to receive one end of a counterbalance spring member, such as springs 78 and 80 shown in FIGS. 3 through 8. The opposite ends of the counterbalance springs 78 are secured to the frame support 12. This arrangement advantageously further reduces the stress on the drive mechanism. In a preferred embodiment, the connecting rods 70 and 72 house adjustment bolts such as an adjustment bolt 82 for permitting adjustment of the tension in the counterbalance springs. Those skilled in the art should appreciate that any number of counterbalance springs may be utilized depending on the size of the gate arm. In the described embodiment, two, three or four counterbalance springs are utilized.

FIG. 8 illustrates connection of the main crank 24 to the gate arm 14. As shown, a mounting bracket or flange 84, having a sleeve 84*a* adapted to mate with the main crank 24 is secured thereto with the use of a locking screw 86, which extends through the main drive shaft. The mounting bracket 84 is also joined with the gate arm 14 with the use of mounting screws such as screw 88. The gate arm 14 also includes a gate arm support 90 for providing additional structural integrity to the connection between the main crank 24 and the gate arm 14.

The security arm is raised and lowered through operation of the linkage mechanism 20, as shown in FIGS. 7 and 8. In FIG. 7, the security arm 14 is disposed in a lowered or substantially horizontal position. To raise the gate arm, the output crankshaft is rotated to transfer torque to the connecting rod 56. This action, in turn, causes rotation of the main crank about the main crank axis 43 and a lifting of the gate arm 14, as denoted by the dashed lines in FIG. 7. As noted above, the linkage arrangement provides a sinusoidal linkage between the main crank 24 and the motor drive output. That is, when viewed as a function of time, the relative main crank angular speed and, therefore, the gate arm speed, is lowest as the gate arm begins an upward cycle even though the motor drive output may be rotated at a relatively constant angular rate. As the arm moves to a position about 45 degrees from horizontal during an upward cycle, the relative arm speed increases to its fastest angular speed during the upward cycle. As the gate arm approaches the upright position, its relative angular speed slows down. In a fully raised position, the linkage mechanism 20 has rotated the gate arm 14 to the position shown in FIG. 8. In this position, the gate arm 14 is moved to a substantially upright position.

As the gate arm is lowered during a downward cycle, the main crank and the gate arm operates with the same sinusoidal characteristic as a function of time. That is, the main crank and gate arm move at a slower relative angular speed as the arm begins to rotate than the angular speed at other locations in the downward cycle. The relative arm speed increases during the downward cycle to its maximum when the gate arm is at about 45 degrees, and then decreases again as the gate arm approaches its horizontal position. The gate arm eventually contacts a stop member 92 at the end of its downward cycle, secured to the frame 22 as shown in FIG. 5. The stop member 92 is preferably fabricated of rubber.

It should be appreciated that as the gate arm is lifted from the horizontal position to the vertical position, progressively less power is required to lift the gate. Thus, a relatively greater amount of power is required to move the gate from a resting, horizontal position. However, relatively less power is required to lift the gate arm as it approaches the substantially upright position. For these reasons, control circuitry is used to adjust the voltage pulse supplied to the DC gearmotor 46 as the gate arm traverses its pathway of travel. One of the many advantages of the present invention is that the power provided to the DC gear motor is dynamically controlled such that no more power than necessary to lift the gate arm is used. Similarly, when the gate arm is lowered, the voltage controller circuit dynamically "brakes" the motor by varying the amount of power provided to the motor to slow and eventually stop the motor and, therefore, the gate arm.

A unique benefit of using a variable speed motor is the ability to achieve asynchronous arm speed profiles. For example, the arm can be raised very quickly on its upward cycle due to the reduced probability that the gate arm will strike a foreign object. During a downward cycle, the initial angular velocity can be faster than the remainder of the downward cycle, progressively decelerating upon reaching an area where the probability of striking a foreign object increases. At a reduced angular velocity, the probability of damage to the gate arm, or for the gate arm to damage a foreign object, is minimized. As explained below, the invention also includes a unique method for determining sudden gate arm deceleration and reversing direction to provide greater control over gate arm movement.

In accordance the invention, an adaptive control system provides varying output signals to actuate the DC gear motor 46. The system also continuously monitors the position and angular velocity of the DC motor. These data are determined by counting pulses corresponding to the output signals applied to the motor.

Figure 9A:
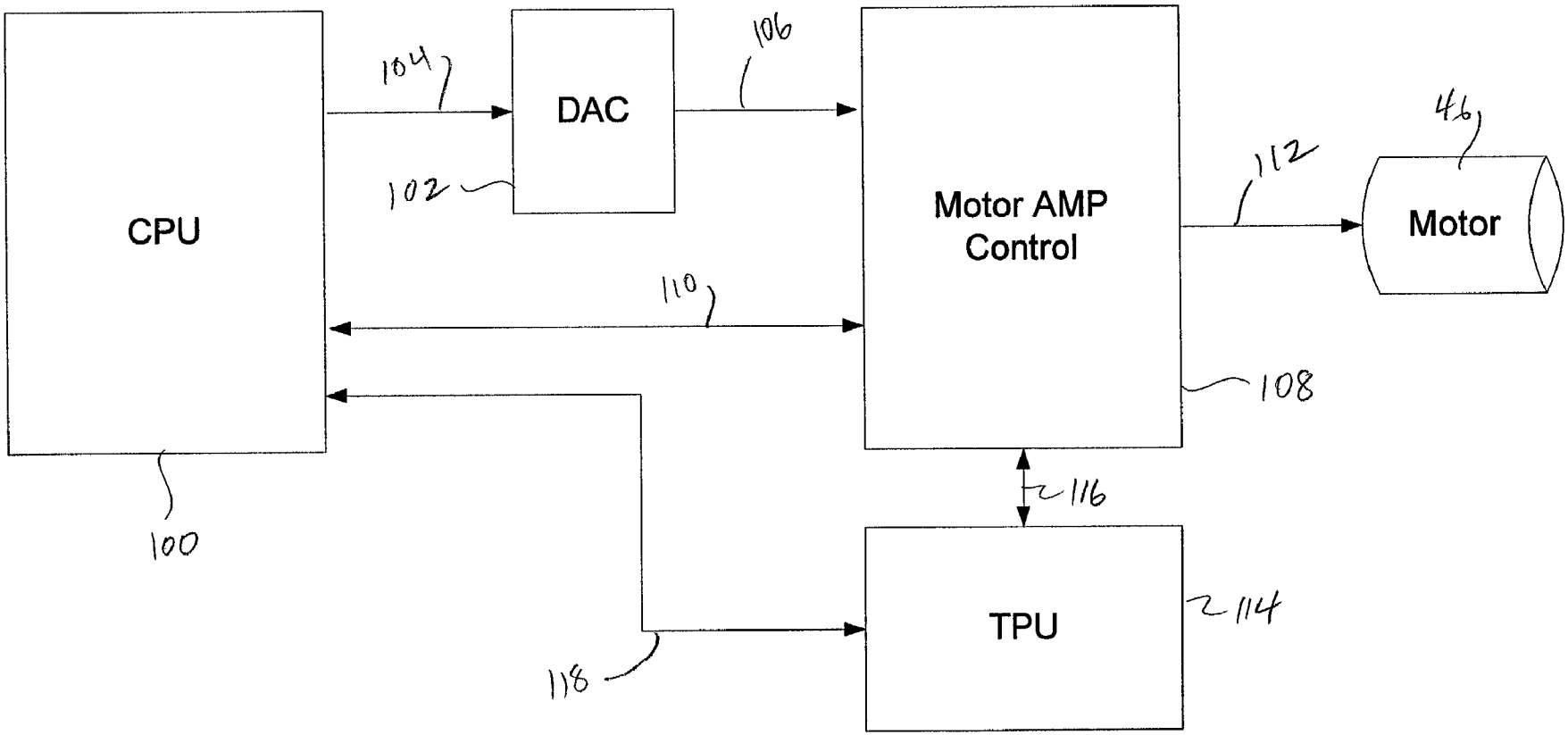
FIG. 9A is a block diagram representation for a control system for the security gate shown in FIGS. 1 through 8.

FIG. 9A illustrates a block diagram representation of one implementation of the control system according to the invention. As shown therein, a special purpose microprocessor-based controller circuit 100 (denoted as CPU) operates in a logical fashion to monitor and control various operations of the gate assembly. These output signals include a digital signal corresponding to a desired output voltage profile that is supplied to a digital-to-analog converter circuit 102 via a line 104. The output profile is developed as a function of, among other things, gate arm size and weight, and the desired angular speed relative to gate arm position. Based on the input digital signal received from the controller circuit 100, the digital-to-analog converter circuit 102 provides an analog output signal, preferably between a range of zero to five volts, on a line 106 to a motor amplifier and control circuit 108.

The motor amplifier and control circuit 108 functions to control operation and regulate the power delivered to the DC motor 46. In addition to the voltage signal representing the desired motor velocity received from the DAC circuit 102, the motor amplifier and control circuit 108 receive input signals from the controller circuit 100 on a line 110. These signals include, as an example, a run/stop command signal and a set direction signal. In response, the motor amplifier and control circuit provides an voltage output signal, of a specific duration and profile, to drive to DC motor 46 on a line 112.

The control circuitry also includes pulse-counting circuitry, in this case implemented with a Time Processing Unit (TPU) circuitry 114. The TPU circuit 114 determines the position and velocity of the DC motor based on data it receives on a line 116 from the motor amplifier and control circuitry 108. In particular, encoding these signals are provided as a series of encoding pulses that indicate motor quadrature pulses. The TPU circuit 114 processes this data to determine a motor output shaft position and angular speed. When appropriate, the TPU circuitry 114 may provide a signal to brake the motor on the line 108. The TPU circuitry 114 also communicates with the controller circuitry 100, as denoted by a line 118.

Figure 9B:
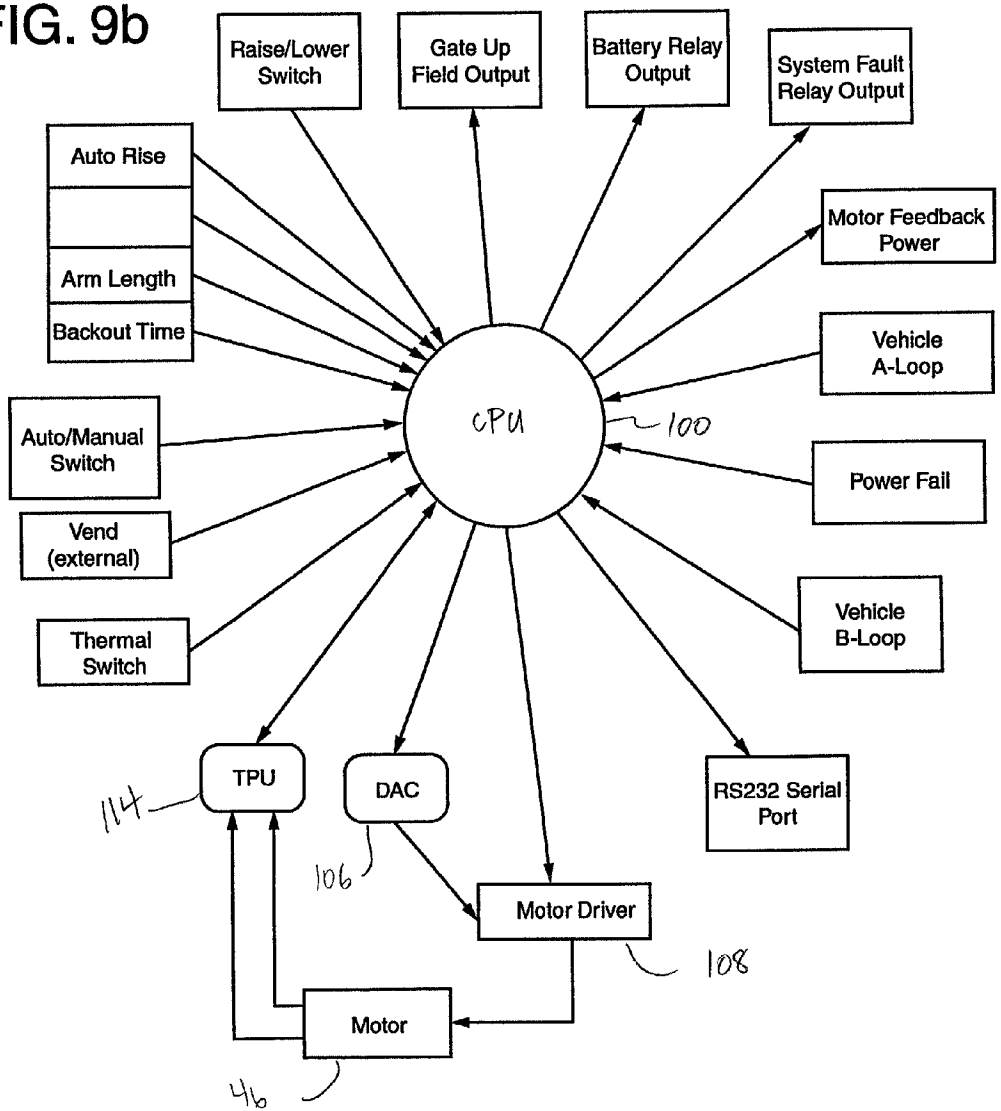
FIG. 9B is a context diagram representation illustrating various inputs and outputs that are handled by the control system shown in FIG. 9A.

As shown in the context diagram of FIG. 9B, the controller circuitry 100 receives and processes various input signals and data. It then provides various control signals to the remaining components of the system. For example, static data concerning an Automatic Rise mode of operation, gate arm length and backout time (currently settable between 15 to 60 seconds) are provided to the controller circuit 100. In one embodiment, such data is provided through the use of DIP switch settings located on the controller circuit board. Other external sensors provide information the controller circuitry 100 as well. These include a signal indicative of an external Raise/Lower switch, an Automatic/Manual Switch, an external Vend signal, and a thermal switch provided by a thermostat (see FIG. 9C). In addition, the microprocessor-based controller circuitry 100 also receives a Power Fail signal from power supply circuitry (see FIG. 9C).

For controlling the security gate, the controller circuitry 100 provides output signals including a Gate Up Field Output switch signal, a Battery Relay Output, a System Fault Relay Output, and a Motor Feedback Power signal.

Figure 9C:
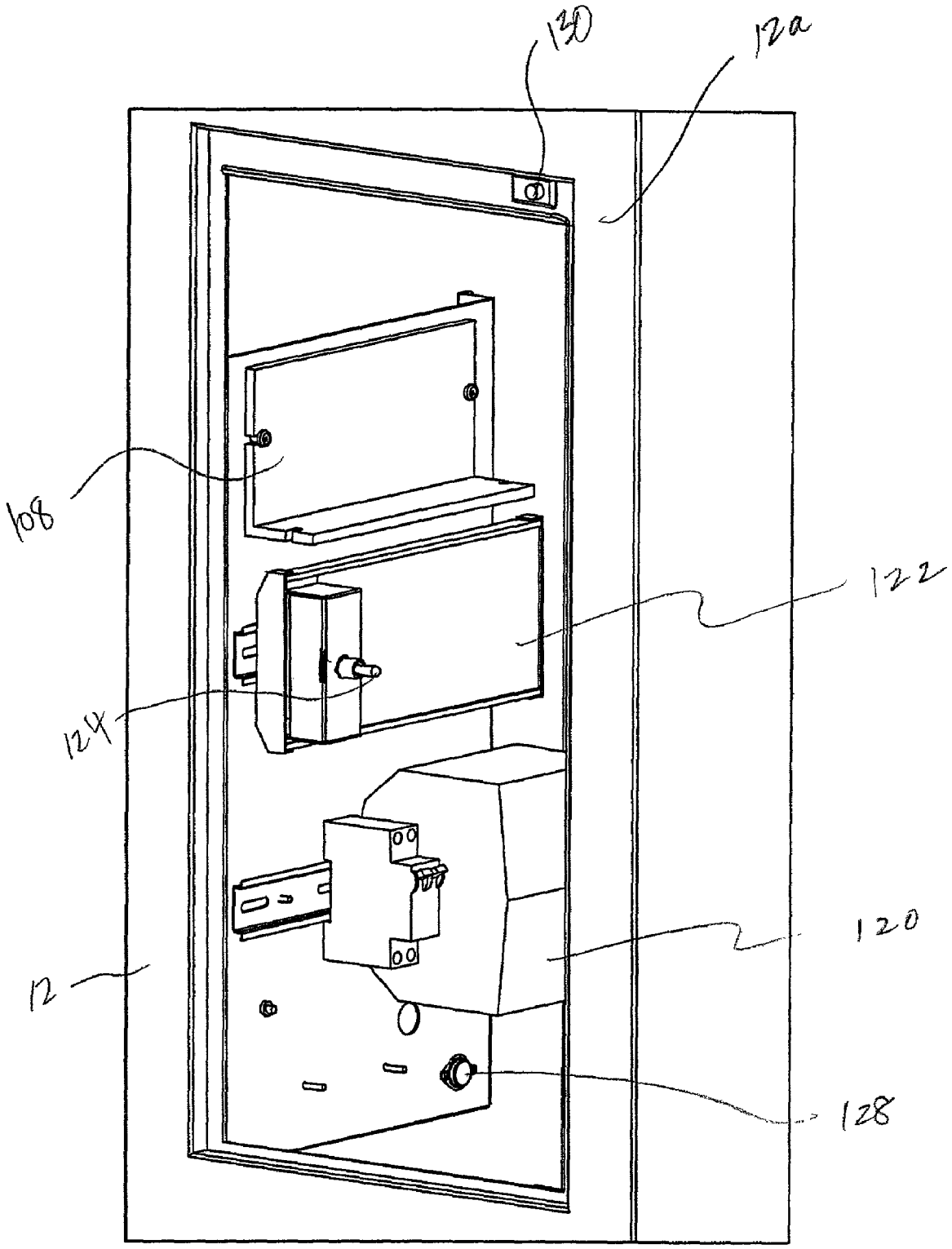
FIG. 9C is a partial perspective view of certain electrical components of the security gate maintained within the gate enclosure.

For controlling the movement of the gate arm, the controller circuitry 100 receives a signal indicative of the presence or absence of a vehicle at a first Loop detector, denoted in FIG. 9C as a Vehicle A-Loop. Also, the controller circuitry 100 receives a signal indicative of the presence or absence of a vehicle at a second Loop detector denoted as a Vehicle B-Loop. The circuitry also receives various signals concerning the gate arm position. These include a Gate Position signal from the TPU circuitry 114. In response, the controller circuitry 100 provides set position information to the TPU circuitry 114 as well as a motor speed digital signal to the Digital-to-Analog conversion circuitry 106. Also, the controller circuitry 100 provides a control signal to a Motor amplification and control circuit 108.

FIG. 9C illustrates the physical location of various electrical components of the security gate. As shown, a Universal Power Supply (UPS) 120, connected to the DC gear-motor and operable to supply 24 volts DC, is disposed within the enclosure 12. In one embodiment, the UPS 120 is operable to accept input voltages ranging from between about 85 VAC to 260 VAC at 50 or 60 Hz. The use of a relatively low-voltage in the security gate provides other advantages as well. Perhaps most importantly, such a non-hazardous voltage level minimizes the risk of shock to service personnel. In addition, the system achieves greater efficiency in operation.

The gate assembly 10 also includes battery back-up capability, which provides a source of power to the motor and controller circuitry in the event of a detection of power failure. In this mode, the gate is operable to lift to its upright position to permit vehicles to exit the parking structure. Preferably, upon detection of a power failure, the system will wait for a predetermined time period, e.g., 10 seconds, before raising the gate arm. This eliminates false responses to transient power interruptions. Likewise, upon the detection of a return of line power, the system delays for a predetermined time period (such as 10 seconds) before normal operation is resumed. A circuit breaker/master system switch may also be used to provide current overload protection as well as a master switch for the system.

The controller circuitry (CPU) 100, the DAC 102 and the TPU circuitry 114, which are also powered by the 24 volts DC output voltage, is disposed proximate to the power supply. In FIG. 9C, these circuits are shown diagrammatically as a circuit board 122. Also, the controller circuitry 100 may include a manual switch 124 for toggling the system between an automatic and a manual mode of operation. In the manual operable, the system operates to raise the gate arm to a fully upright position. Setting this switch 124 to the Automatic position causes the gate to resume normal operation, as explained herein. The motor amplification and control circuitry 108 is also located within the enclosure, preferably in proximity to the gear-motor 46 itself.

For monitoring the temperature within the enclosure, a thermostat 128 is disposed in an enclosure sidewall. FIG. 9C also illustrates a door safety switch 130. The door safety switch 130 disconnects power to the components when the panel access door 13 is opened, as shown in FIG. 9C.

FIGS. 10A and 10B, 11A and 11B, and 12A and 12B, illustrate the security gate 10 in various operable modes. In FIGS. 10A and 10B, for example, the gate arm is used in conjunction with a pair of inductive loop detectors 150 and 152. This mode of operation is an automatic mode wherein the gate arm is lifted when a vehicle is sensed at a first loop detector 150, which corresponds to the Vehicle A-Loop sensor in the context diagram of FIG. 9B. This loop detector 150 generates a signal, which is received by the control circuitry. In response, the gate arm 14 is lifted to permit passage of the vehicle. As the vehicle passes when the gate arm is in its upright position, a second loop detector 152, corresponding to the Vehicle B-Loop detector in FIG. 9B, detects passage of the vehicle. After a predetermined time delay and/or a sensing of the absence of the vehicle by the detector 152, the gate arm is counter-rotated to the closed position, assuming the first vehicle sensor 150 detects no additional vehicles.

FIGS. 11*a* and 11*b* show a further mode of operation. In this mode of operation, the gate assembly 10 is used in conjunction with a vending device 154. The vending device 154 may include a card reader, a camera or scanning apparatus, a vending machine, or any other suitable vending device. As with the mode of operation shown in FIGS. 10A and 10B, in this mode of operation first and second vehicle loop detectors 150 and 152 are also employed. In particular, the vehicle loop detector 150 (Vehicle A-Loop detector) provides a signal to the gate arm control circuitry when a vehicle has approached. Upon receipt of the signal provided by the loop detector 150 as well as a signal generated by the vending device 154 indicating a successful vend, the gate arm 14 is actuated by permit passage of the vehicle. When the vehicle passes a second loop detector 152 (Vehicle B-Loop detector), and after a predetermined amount of time, the gate arm 14 is counter-rotated to a closed or horizontal position, assuming that no vehicle is present at the location of the first loop detector 150.

FIGS. 12A and 12B show a slightly different mode of operation of the security gate 10. This mode of operation may be used to permit vehicles to enter and exit from the same pathway. In the mode of operation illustrated in FIGS. 12A and 12B, a vending device 154 is utilized to permit the entrance of traffic flowing in a first direction denoted by an arrow 156 in FIG. 12B. As the vehicle passes through in this direction, a loop detector 152 (Vehicle B-Loop detector) detects passage thereof and provides a signal to the gate assembly 10. Traffic exiting the parking structure would move in a direction denoted by an arrow 158. The configuration shown in FIGS. 12A and 12B includes a second loop detector 150 (Vehicle A-Loop detector). This loop detector 150 detects the presence of a vehicle approaching in the direction of arrow 158 and provides a signal to the control software of the gate assembly. In response, the gate assembly actuates the gate arm 14 to permit exit of the vehicle. The vehicle will also traverse the loop detector 152 that passes a signal to the control circuitry for the gate arm. In response, the gate assembly is counter-rotated until it rests at a closed or horizontal position.

In a preferred embodiment, the controller circuitry 100 executes a control program based on object-oriented programming techniques. As described herein, the term "object-oriented programming" (OOP) generally refers to a type of programming that views programs as performing operations on a set of objects. The operations are performed with the use of message passing back and forth between independent objects. In general, the objects themselves correspond to entities, either conceptual or physical, of interest in the spraying system. The concept of an object combines the attributes of procedures and data such that there is a collection of some private data and a set of operations that can access that data. Objects store data in variables and respond to messages by executing procedures or methods.

Accordingly, an object will generally refer to a self-contained software entity that includes both data and procedures to manipulate the data. The properties of an object are defined according to a unique object class, or hierarchy of classes, created by a computer programmer. The class also defines the various interfaces such that, when an object is instantiated, allow the object to exchange data with other objects. The process by which objects may be accessed without knowledge of the internal data and mechanisms of the object is known as data encapsulation. In this way, objects can communicate with other objects according to the methods of that object's interface.

The security gate control system uses object-oriented techniques within its system programs. The objects of the security gate are modeled after the functions performed within the control hardware itself. For example, referring to FIG. 13, the security gate control system uses classes of objects to coordinate the various control circuitry and other sub-systems utilized by the security gate. The function, which is internal to the control system, is required to insure that the security control circuitry ultimately produces appropriate signals to the motor amplifier and control circuitry 108.

Figure 13:
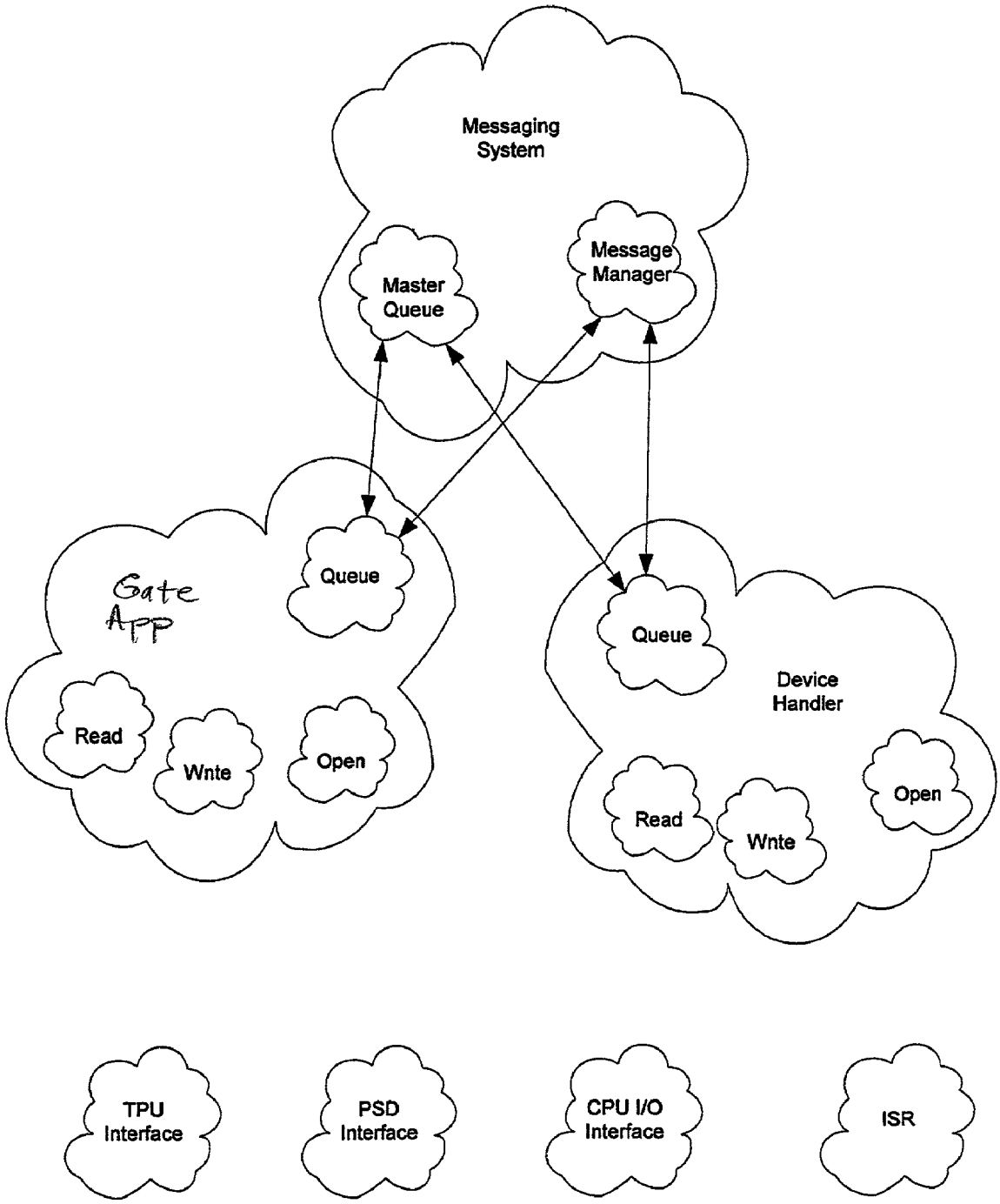
FIG. 13 is a Booch diagram for object-oriented control software employed in the security gate control system of FIG. 9A.

The diagram at FIG. 13 is a simplified schematic Booch diagram of the class structure of the security gate control system. This diagram includes cloud-shaped symbols that may represent certain class definitions. Additionally, this diagram indicates certain inter-object communication paths used to implement the control program. This is a simplified diagram because it does not convey the complexity of the many class definitions that are "child" or sub-classes of the representative or parent classes. Nevertheless, the relevant features of the security gate control system may be described by reference to this diagram.

The control software is managed by objects instantiated from certain classes, as shown in FIG. 13. In the preferred implementation of the invention, a relatively low cost messaging mechanism is employed that eliminates the need for use of real-time operating system message management services, which involve a more complicated implementation and increased cost. According to the invention, a Message Manager Object is employed to handle messages passed between the various objects, as shown in FIG. 13. When another object wishes to receive or send messages, it first registers with the Message Manager by making a call to the Message Manager that includes the registering object's unique target Id., and an address of its method that will handle the message. When another object seeks to send a message to the registered object, the Message Manager routes the message to the registered object.

To pass a message, such as to invoke a function of another object, the Message Manager Object functions to maintain a message queue. Then, for an object to send a message, the object calls one of the Message Manager functions, SendMsg, and passes a pointer to that function. The Message Manager then stores a local copy of the message in its queue. Later, when the Message Manager executes, it routes the messages in its queue to the various target message handler functions, as previously registered with the Message Manager.

As explained above, the remaining objects in the system that will send and receive messages are defined to include a message handler function. Upon receipt of a message, the message handler for the receiving object also makes a copy of the message in its message queue. When the target object is executed, the messages in its private queue are retrieved and processes in turn. The message handler thus functions to queue the messages it receives in a private queue for the object. For handling high priority messages, the message handler inserts the message at the front of its queue rather than at the end.

The diagram of FIG. 13 shows several such objects that access messages from the Message Manager object. For example, a Device Handler Subsystem Class is defined according to this embodiment. Objects instantiated from this class include a Device Input/Output object for handling data flow through the system as well as a Private Queue Object for maintaining messages to be handled.

FIG. 13 also illustrates a Gate Application Class. Objects instantiated from this class are used to develop the various signals and to control data flow through the control software. For example, a Gate Application Object may include methods and data for obtaining an appropriate output voltage profile to be applied to the motor amplification and control circuitry. In addition, objects instantiated from this class include algorithms for controlling and/or maintaining the motor drive signal based on messages received from other objects concerning operating characteristics of the system. In addition to other functions, the Gate Application Object may also define the mode of operation, as explained in reference to FIGS. 10A–B, 11A–B and 12A–B.

Also, FIG. 13 also illustrates the manner in which the Gate Application and the Device Handler Objects communicate with interface objects. To perform this function, the Gate Application Class and the Device Handler Class may include certain read, write and open class definitions. Objects instantiated from these latter classes communicate with objects instantiated from various interface classes. Among others, a TPU Interface Object, a PSD Interface Object, a CPU I/O Interface, and an Interrupt Service Routine (ISR) Object are instantiated from these interface classes. This permits commands to be transmitted to other portions of the system through inter-object communication.

For remote evaluation or monitoring of the various signals that are developed, the control system is adapted for remote communication. This may require a network connection, such as connection with a Wide Area Network (WAN) that is either hard-wired or wireless. The various signals that are often transmitted to a remote location include certain gate controller conditions, the operating mode, and/or any fault conditions. Also, the gate controller is preferably capable of receiving information from a remote location. This includes program downloads such as for software version updates and/or diagnostic information. Optionally, the controller may receive remote command signals for actuating the gate arm. To implement this capability, the Messaging System is modified to receive messages of external sources.

Various advantages flow readily from the invention. For example, the invention may be implemented in many different geographical regions regardless of the AC power service used in the region (e.g., 120 volts at 60 cycles per second or 240 volts at 50 cycles per second). Additionally, the present invention is more reliable, requires less maintenance and is less likely to fail as compared to known gate structures due to the reduced number and complexity of the components used without any reduction or detrimental effect to the functionality and reliability. Also, the gate arm of the present invention has a handing design, namely, a central drive shaft that passes through a centerline of the gate arm.

Thus, the security gate may be easily installed from either side of a roadway, either in a left-handed orientation or a right-handed orientation.

Accordingly, a security gate meeting the above objectives has been described. The gate is precisely actuated and deactuated with the use of a control circuit that is operative to produce a series of control pulses, of a specific duration at known times, to a DC gear-motor. The motor output, in turn, is positively linked to the gate arm. In one preferred embodiment, the invention is controlled through an object-oriented control program.

The security gate of the present invention also eliminates the need for multiple position sensors to determine whether the gate arm is up, down or in the process of being moved. Additionally, the invention eliminates the requirement of sensors to detect whether the gate arm has hit or has been hit by a foreign object, such as a vehicle, as the gate arm lowers. Rather, the DC gear motor preferably comprises a circuit that outputs encoded electrical pulses corresponding to the position of the motor. Thus, the number and frequency of output pulses generated by the circuit are counted to determine the precise location and speed of the gate arm (e.g., fully horizontal, fully vertical or a position in between). If the gate arm motion is interrupted, for example by hitting a vehicle, the software incorporated into the controller determines the change in angular velocity of the gate arm. This fault condition causes the software to stop and/or reverse the motion of the gate arm. Thus, the present invention simplifies the design and implementation of the gate arm through the elimination of components and the reduction of equipment failure occurrence.

The invention further provides efficiencies in the amount of power utilized. As previously indicated, the amount of power required to lift a gate arm is a function of gate arm length, gate arm weight, and the angular position from which the gate arm is being lifted or lowered. The amount of power required to lift the gate arm depends on other factors. For example, snow accumulated on the gate arm increases the weight of the gate arm and, accordingly, the amount of power required to lift the gate arm. The present invention dynamically adjusts the amount of power provided to the DC gear-motor depending on the size, weight and position of the gate arm as monitored or input to the control software. The software further includes various distinct output voltage profiles to in turn lift and lower the gate arm. Additionally, the software used in conjunction with the present invention is intelligent and adaptive, such that if a particular profile is not successful in lifting the gate arm the software can change to another profile to allow proper functioning of the gate arm.

The invention is not intended to be limited to the presently contemplated best mode for practicing the same, as set forth in the above detailed description of presently preferred embodiments. To the contrary, the invention also encompasses variations of the specific embodiments described herein. Accordingly, it should be understood that the invention is not intended to be limited to this disclosure of preferred embodiments. Instead, it is directed to the subject matter as set forth in the appended claims, and equivalents thereof.

What is claimed is:

1. A security gate assembly comprising:

an elongate gate arm movable along a defined pathway of travel;

a DC motor having an output disposed to provide a torque upon receipt of a first series of output pulses;

a linkage mechanism attached to one end of said gate arm and to the DC motor output and disposed to cause rotation of the gate arm in accordance with the DC motor output; and an adaptive control circuit disposed to monitor a plurality of operating conditions including data concerning the weight of the gate arm, and to develop a signal indicative of the position of the gate arm, said adaptive control circuit providing said first output pulses to said DC motor in response to the plurality of operating conditions including the weight of the gate arm such that said first output pulses are varied in accordance with at least said signal indicative of the position of the gate arm and said data concerning the weight of the gate arm.

2. The invention as in claim 1 wherein said elongate gate arm is of sufficient length to impede the passage of a motor vehicle.

3. The invention as in claim 1 wherein the adaptive control circuit is further disposed to provide second output pulses to cause counter-rotation of the gate arm.

4. The invention as in claim 1 wherein the adaptive control circuit senses a relative position and speed of the gate arm as it traverses its defined pathway of travel.

5. The invention as in claim 4 wherein the adaptive control circuit provides an output signal to the DC motor to cause the gate arm to cease movement along the pathway of travel when a change in angular velocity is sensed.

6. The invention as in claim 5 wherein the adaptive control circuit includes a digital-to-analog converter circuit which provide the output signal in analog form to the DC motor.

7. The invention as in claim 6 wherein said linkage mechanism further includes a curved link piece attached to both said DC motor output and said gate arm.

8. The invention as in claim 1 wherein the adaptive control circuit includes a time processing unit for determining position and velocity of the DC motor based upon encoding pulses received from the DC motor.

9. The invention as in claim 1 wherein the linkage mechanism comprises a four-bar linkage member for coupling said DC motor output with said gate arm.

10. The invention as in claim 1 wherein the defined pathway of travel includes a generally horizontal position and a generally vertical position.

11. The invention as in claim 10 wherein the linkage mechanism adjusts the DC motor output such that the speed of the gate arm varies sinusoidally between the generally horizontal position and the generally vertical position.

12. The invention as in claim 1 wherein the security gate assembly further comprises at least one inductive loop detector communicating with the adaptive control circuit for detecting presence of a vehicle.

13. The invention as in claim 1 wherein the security gate assembly further comprises a vending device communicating with the adaptive control unit.

14. The invention as in claim 13 wherein the vending device is selected from the group consisting of a card reader, a camera, and a vending machine.

15. The invention as in claim 1 further comprising a Universal Power Supply adapted to accept AC voltage and operable to supply 24 volt DC power to the DC motor.

* * * * *